US009127849B2

(12) United States Patent
Kang et al.

(10) Patent No.: US 9,127,849 B2
(45) Date of Patent: Sep. 8, 2015

(54) COOKING APPLIANCE

(75) Inventors: Myeong Yeol Kang, Seoul (KR); Eun Hyae Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 593 days.

(21) Appl. No.: 13/263,673

(22) PCT Filed: Sep. 3, 2009

(86) PCT No.: PCT/KR2009/004958

§ 371 (c)(1),
(2), (4) Date: Oct. 7, 2011

(87) PCT Pub. No.: WO2010/131804

PCT Pub. Date: Nov. 18, 2010

(65) Prior Publication Data

US 2012/0031283 A1 Feb. 9, 2012

(30) Foreign Application Priority Data

May 11, 2009 (KR) ..... 10-2009-0040992

(51) Int. Cl.

| | |
|---|---|
| ***A47J 37/07*** | (2006.01) |
| ***F24C 15/32*** | (2006.01) |
| ***F24C 14/00*** | (2006.01) |
| ***F24C 15/00*** | (2006.01) |

(52) U.S. Cl.
CPC ..... *F24C 15/327* (2013.01); *F24C 14/005* (2013.01); *F24C 15/00* (2013.01)

(58) Field of Classification Search
CPC ..... F24F 3/14; F24F 11/00
USPC ..... 219/401, 402, 441, 442, 492; 99/330, 99/331, 324, 339, 349, 369, 473, 475; 126/20, 348, 369, 21 A
See application file for complete search history.

(56) References Cited

U.S. PATENT DOCUMENTS

| | | | | |
|---|---|---|---|---|
| 4,484,065 | A * | 11/1984 | Ueda | 219/492 |
| 4,495,932 | A * | 1/1985 | Bratton | 126/20 |
| 2004/0025910 | A1 * | 2/2004 | Kanzaki et al. | 134/95.1 |
| 2006/0108433 | A1 * | 5/2006 | Fossati et al. | 236/44 C |
| 2007/0062927 | A1 * | 3/2007 | Sells et al. | 219/401 |
| 2009/0078291 | A1 * | 3/2009 | Kang et al. | 134/22.1 |

FOREIGN PATENT DOCUMENTS

| | | | |
|---|---|---|---|
| EP | 0556166 | * | 11/1995 |
| JP | 2004-69175 | A | 3/2004 |
| JP | 2005-114350 | A | 4/2005 |
| KR | 2000-0000966 | U | 1/2000 |
| KR | 10-2006-0115327 | A | 11/2006 |
| KR | 10-2008-0032708 | A | 4/2008 |
| KR | 10-0848912 | B1 | 7/2008 |
| KR | 10-2009-0030974 | A | 3/2009 |

* cited by examiner

*Primary Examiner* — Reginald L Alexander
*Assistant Examiner* — Joseph Iskra
(74) *Attorney, Agent, or Firm* — Birch, Stewart, Kolasch & Birch, LLP

(57) ABSTRACT

Provided is a cooking appliance. Steam generated in a steam generation part is selectively supplied into a cooktop part or an oven chamber. The steam supplied into the cooktop part is used for soaking foreign materials attached to a top surface of the top plate to remove the foreign materials. Thus, the steam generated in one steam generation part may be used in a lot of uses.

17 Claims, 5 Drawing Sheets

COOKING APPLIANCE

CROSS-REFERENCE TO RELATED APPLICATIONS

The present application claims priority under 35 U.S.C. 119 and 35 U.S.C. 365 to Korean Patent Application No. 10-2009-0040992 (filed on May 11, 2009), which is hereby incorporated by reference in its entirety.

BACKGROUND

The present disclosure relates to a cooking appliance, and more particularly, to a cooling appliance in which steam is selectively supplied into a cooktop part and an oven part.

Cooking appliances are home appliances for heating an object to be heated (hereinafter, referred to as a heated object) using electricity or gas. In recent, such a cooking appliance includes a steam generation part generating steam for cooking heated objects.

SUMMARY

Embodiments provide a cooking appliance which uses steam in a lot of uses.

Embodiments provide a cooking appliance in which steam generated in one steam generation part is used for in a lot of uses.

In one embodiment, a cooking appliance includes: a cooktop part heating an object to be heated; an oven part in which the object is heated, the oven part being disposed under the cooktop part; and a steam generation part generating steam supplied onto atop surface of the cooktop part and into the oven part.

In another embodiment, a cooking appliance includes: a cooktop cover including a top plate, at least one heating source heating the object seated on the top plate, and a cooktop cover for selectively opening or closing the top plate; an oven part disposed under the cooktop part, the oven part including an oven chamber and at least one heating source for heating the object received in the oven chamber; and a steam generation part generating steam supplied into at least one of a space between the top plate and the cooktop cover and the inside of the oven chamber.

The details of one or more embodiments are set forth in the accompanying drawings and the description below. Other features will be apparent from the description and drawings, and from the claims.

DETAILED DESCRIPTION OF THE EMBODIMENTS

Hereinafter, a cooking appliance according to a first embodiment will be described in detail with reference to accompanying drawings.

Figure 1:
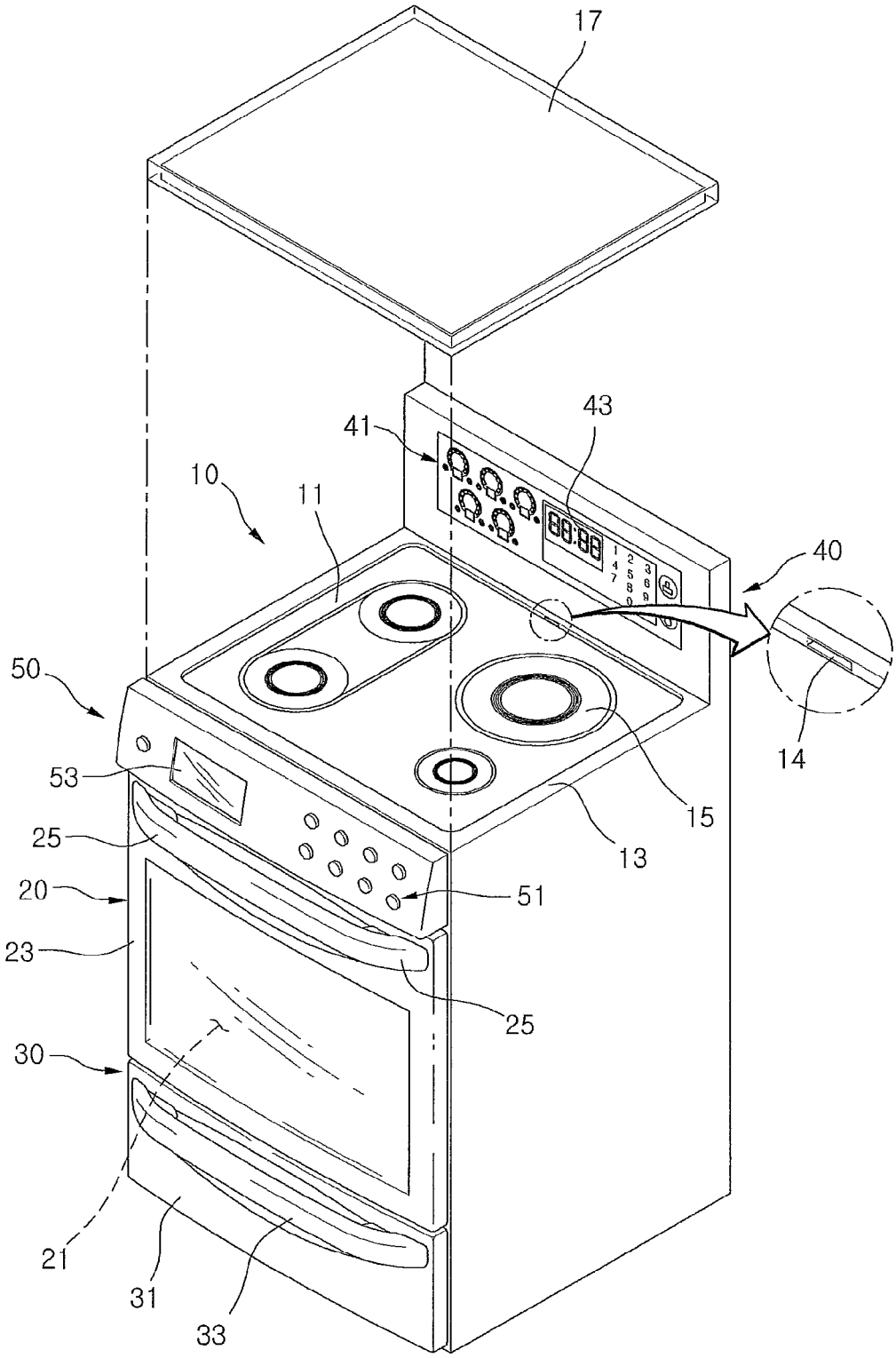
FIG. 1 is a perspective view of a cooling appliance according to a first embodiment.
Figure 2:
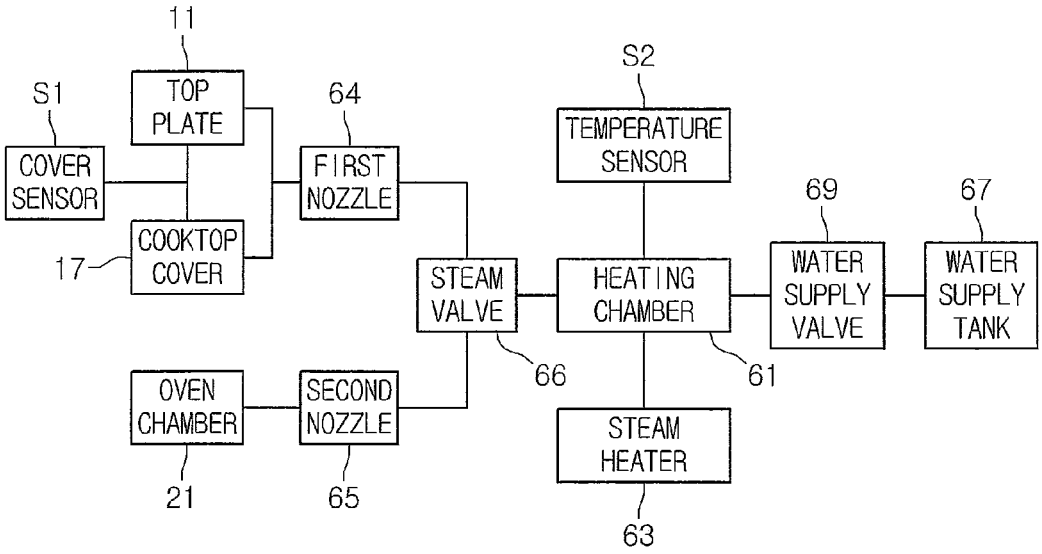
FIG. 2 is a schematic block diagram of the cooking appliance according to the first embodiment.

FIG. 1 is a perspective view of a cooling appliance according to a first embodiment. FIG. 2 is a schematic block diagram of the cooking appliance according to the first embodiment.

Referring to FIG. 1, a cooktop 10 is disposed on a top surface of a cooking appliance. Also, an oven part 20 and a drawer part 30 are sequentially disposed under the cooktop part 10. A food to be cooked (hereinafter, referred to as a cooked food) is cooked in the cooktop 10 and the oven part 20. The cooked food or a container may be warm in the drawer part 30.

In detail, the top plate 11 defines a top surface of the cooktop 10. A ceramic glass may be used as the top plate 11. The cooked food is seated on the top surface of the top plate 11. Also, a top frame 13 is disposed on an edge of the top plate 11. The top frame 13 has a top surface higher than that of the top plate 11. Also, a steam injection hole 14 is defined in a side of a rear end of the top frame 13. The steam injection hole 14 is a hole through which steam is injected through a first nozzle 64 that will be described later.

A plurality of heating sources 15 are disposed under the top plate 11. The heating sources 15 may heat the food seated on the top plate 11. A radiant heater or induction heater may be used as the heating sources 15.

The top plate 11 is selectively opened by a cooktop cover 17. The cooktop cover 17 may have a shape in which a predetermined space is defined between the cooktop cover 17 and the top plate 11, e.g., a flat hexahedron shape with an opened bottom side. Also, the cooktop cover 17 may be formed of a partially transparent or semitransparent material to allow a user to confirm the space between the top plate 11 and the cooktop cover 17 through his/her naked eye.

Referring to FIG. 2, a cover sensor S1 is disposed on the cooktop part 10. The cover sensor S1 may detect whether the top surface of the top plate 11 is covered by the cook top cover 17.

An oven chamber 21 is defined inside the oven part 20. The food is heated within the oven chamber 21. For this, at least one heating source (not shown) is disposed within the oven chamber 21.

The oven chamber 21 is selectively covered by an oven door 23. A door handle 25 to be grasped by the user to open the oven door 23 is disposed on the oven door 23.

Also, the drawer part 30 includes a drawer 31 withdrawn in a drawer type. The food or container is received into the drawer 31. The drawer part 30 includes a heating source (not shown) for warming the food or container received into the drawer 31. Also, a drawer handle 33 to be grasped by the user to withdraw the drawer 31 is disposed on the drawer 31.

A first control part 40 is disposed on a rear end of the top surface of the cooktop part 10. The first control part includes an input unit 41 (hereinafter, referred to as a 'first input unit') for receiving a manipulation signal for an operation of the cooktop part 10 and a manipulation signal for the supply of the steam into the space between the top plate 11 and the cooktop cover 17 and an output unit 43 (hereinafter, referred to as a 'first output unit') for outputting information with respect to an operation of the cooktop part 10 and information and signal with respect to the supply of the steam into the space between top plate 11 and the cooktop cover 17.

Also, a second control part 50 is disposed on an upper portion of a front surface of the oven part 20. The second control part 50 includes an input unit 51 (hereinafter, referred to as a 'second input unit') for receiving manipulation signals for operations of the oven part 20 and the drawer part 30 and for supplying the steam into the oven part 21 and an output unit 53 (hereinafter, referred to as a 'second output unit') for outputting information and signal with respect to operations of the oven part 20 and the drawer part 30 and information and signal with respect to the steam supply into the oven part 21.

The steam may be selectively supplied into the space between the top plate 11 and the cooktop cover 17 and the inside of the oven chamber 21. The steam supplied into the space between the top plate 11 and the cooktop cover 17 may be used for cleaning the top surface of the top plate 11. Also, the steam supplied into the oven chamber 21 may be used for cooling the food within the oven chamber 21. Also, the steam supplied into the oven chamber 21 may be used for cooking the food.

Referring to FIG. 2, the steam supplied into the space between the top plate 11 and the cooktop part and the inside of the oven chamber 21 is generated by the steam generation part. The steam generation part includes a heating chamber 61, a steam heater 63, first and second nozzles 64 and 65, a water supply tank 67, a water supply valve 69, and a temperature sensor S3.

In detail, steam water for generating steam is stored in the heating chamber 61. The heating chamber 61 is not limited to its shape or size.

The steam heater 63 heats the steam water stored in the heating chamber 61 to generate steam. Here, various heaters, for example, a sheath heater may be used as the steam heater 63.

The first and second nozzles 64 and 65 may inject the steam generated by heating the steam water stored in the heating chamber 61 using the steam heater 63 into the space between the top plate 11 and the cooktop cover 17 or the inside of the oven chamber 21. For this, the first and second nozzles 64 and 65 communicate with the space between the top plate 11 and the cooktop cover 17 or the inside of the oven chamber 21. In the current embodiment, the first nozzle 64 may communicate with the steam injection hole 14.

The steam valve 66 may be controlled so that the steam is selectively supplied into the space between the top plate 11 and the cooktop cover 17 or the inside of the oven chamber 21 through the first and second nozzles 64 and 65. Here, the steam valve 66 may be controlled so that the steam is supplied into the space between the top plate 11 and the cooktop cover 17 through the first nozzle 64, the inside of the oven chamber 21 through the second nozzle 65, or the space between the top plate 11 and the cooktop cover 17 or the inside of the oven chamber 21 through the first and second nozzles 64 and 65.

The steam water supplied into the heating chamber 61 is stored in the water supply tank 67. The water supply tank 67 may be detachably disposed on a side of the cooking appliance.

The water supply valve 69 may be controlled to selectively supply the steam water stored in the water supply tank 67 into the heating chamber 61.

The temperature sensor S2 detects a temperature of the inside of the heating chamber 61 heated by the steam heater 63. When the temperature of the inside of the heating chamber 61 detected by the temperature sensor S2 is above a preset safety temperature, it may be determined that the amount of the steam water stored in the heating chamber 61 is less than a preset minimum water storage amount or the steam heater 63 is overheated. Thus, in this case, the water supply valve 69 is operated to supply the steam water stored within the water supply tank 67 into the heating chamber 61 or an operation of the steam heater 63 is finished.

Hereinafter, an operation of the cooking appliance according to the first embodiment will be described in detail with reference to accompanying drawings.

To supply the stem into the space between the top plate 11 and the cooktop cover 17, the user inputs a manipulation signal (hereinafter, for convenience of description, referred to as a 'first manipulation signal') into the first input unit 41. When the first input unit 41 receives the first manipulation signal, steam is generated in the steam generation part. Then, the generated steam is supplied into the space between the top plate 11 and the cooktop cover 17. The foreign materials attached to the top surface of the top plate 11 may be soaked by the steam supplied into the space between the top plate 11 and the cooktop cover 17. Thus, the top plate 11 may be more easily cleaned.

In detail, the steam heater 63 heats the steam water stored in the heating chamber 61 to generate steam. Also, the steam valve 66 is controlled so that the steam generated by heating the steam water stored in the heating chamber 61 using the steam heater 63 is supplied into the space between the top plate 11 and the cooktop cover 17 through the first nozzle 64.

When the steam is completely supplied into the space between the top plate 11 and the cooktop cover 17, the first output unit 43 outputs a signal for informing the completion of the steam supply. For example, the first output unit 43 may inform the completion of the steam supply through sound, character, emblem, beep sound, or illumination. Also, when the steam supply into the space between the top plate 11 and the cooktop cover 17 is completed and a preset time elapses, the first output unit 43 outputs a signal for informing the completion of the steam supply and the time elapse. This is done for a reason which is for informing a time for soaking the foreign materials attached to the top plate 11 using the steam supplied into the space between the top plate 11 and the cooktop cover 17 to the user.

When the first input unit 41 receives the first manipulation signal in a state where the cover sensor S1 detects that the top surface of the top plate is opened by the cooktop cover 17, the first output unit 43 outputs a signal for informing this state. Also, during the supply of the steam into the space between the top plate 11 and the cooktop cover 17, when the cover sensor S1 detects the opening of the top surface of the top plate 11 by the cooktop cover 17, the first output unit 43 outputs a signal for informing this state. Also, during the supply of the steam into the space between the top plate 11 and the cooktop cover 17, when the cover sensor S1 detects the opening of the top surface of the top plate 11 by the cooktop cover 17, the supply of the steam into the space between the top plate 11 and the cooktop 17 is stopped.

This is done for a reason in which it prevent the steam from being unnecessarily supplied or spread to the outside to damage the user in the state where the top plate 11 is opened by the cooktop cover 17. Thus, the steam may be supplied into the space between the top plate 11 and the cooktop cover 17 after the top plate 11 is closed by the cooktop cover 17.

To supply the steam into the oven chamber 21, the user inputs a manipulation signal (hereinafter, for convenience of description, referred to as a 'second manipulation signal') into the second input unit 51. When the second input unit 51 receives the second manipulation signal, the steam is supplied into the oven chamber 21. Also, the steam supplied into the oven chamber 21 may be used for cooking the food within the oven chamber 21 or cleaning the inside of the oven chamber 21. Also, the steam valve 66 is controlled so that the steam generated by heating the steam water stored in the heating chamber 61 using the steam heater 63 is supplied into the oven chamber 21 through the second nozzle 65.

To supply the stem into the space between the top plate 11 and the cooktop cover 17 and the inside of the oven chamber 21, the user inputs first and second manipulation signals into the first and second input units 41 and 51. Alternatively, one of the first and second input units 41 and 51 may receive a separate manipulation signal for supplying the steam into the space between the top plate 11 and the cooktop cover 17 and the inside of the oven chamber 21. Also, the supply of the steam into the space between the top plate 11 and the cooktop cover 17 and the supply of the steam into the oven chamber 21 may be performed in the same process as those of the supply of the steam into the space between the top plate 11 and the cooktop cover 17 and the supply of the steam into the oven chamber 21, which are described above.

Hereinafter, a cooking appliance according to a second embodiment will be described in detail with reference to accompanying drawings.

Figure 3:
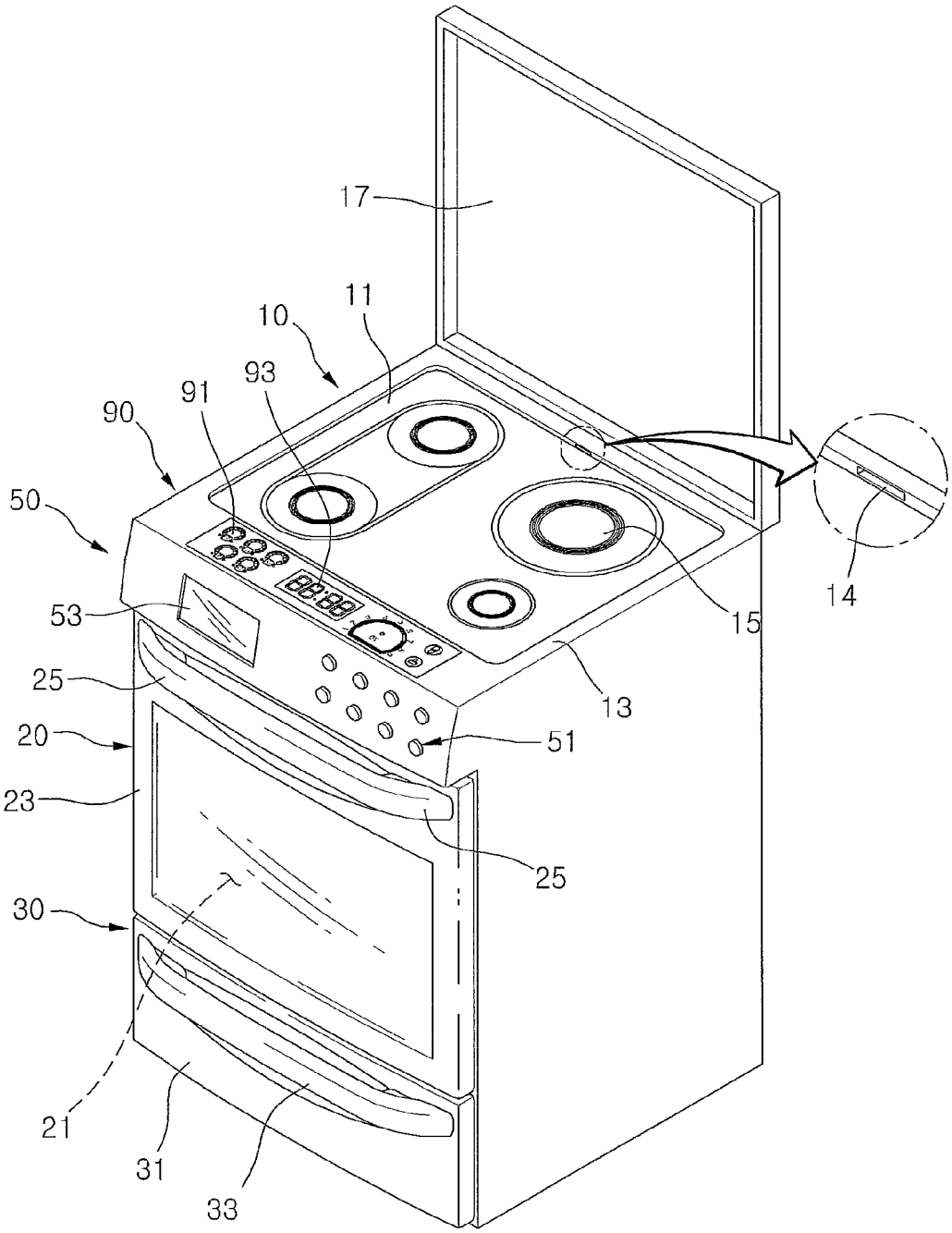
FIG. 3 is a perspective view of a cooking appliance according to a second embodiment.

FIG. 3 is a perspective view of a cooking appliance according to a second embodiment. Here, the fundamentally same portions as those of the above first embodiment are denoted by the same reference numerals as those of FIGS. 1 and 2 and their detained descriptions will be omitted.

Referring to FIG. 3, a cooktop cover 17 is rotatably disposed with respect to a rear end thereof to selectively open or close a top plate 11. Thus, to cook a food using a heating source 15 in a cooktop part 10, a user rotates the cooktop cover 17 with respect to the rear end thereof to open the top plate 11. Also, to remove foreign materials from a top surface of the top plate 11 using steam, the cooktop cover 17 is rotated with respect to the rear end thereof to open the top plate 11.

In the current embodiment, a first control part 40 is disposed on a front end of the top surface of the cooktop part 10. This is done for a reason in which the cooktop cover 17 is rotated to open the top plate 11 under the control of the first control part 40 without interfering. The first control part 40 includes a first input unit 41 for receiving a manipulation signal for an operation of the cooktop part 10 and a manipulation signal for the supply of the steam into the space between the top plate 11 and the cooktop cover 17 and a first output unit 43 for outputting information and signal with respect to an operation of the cooktop part 10 and information and signal with respect to the supply of the steam into the space between top plate 11 and the cooktop cover 17.

Hereinafter, a cooking appliance according to second to fifth embodiments will be described in detail with reference to accompanying drawings.

Figure 4:
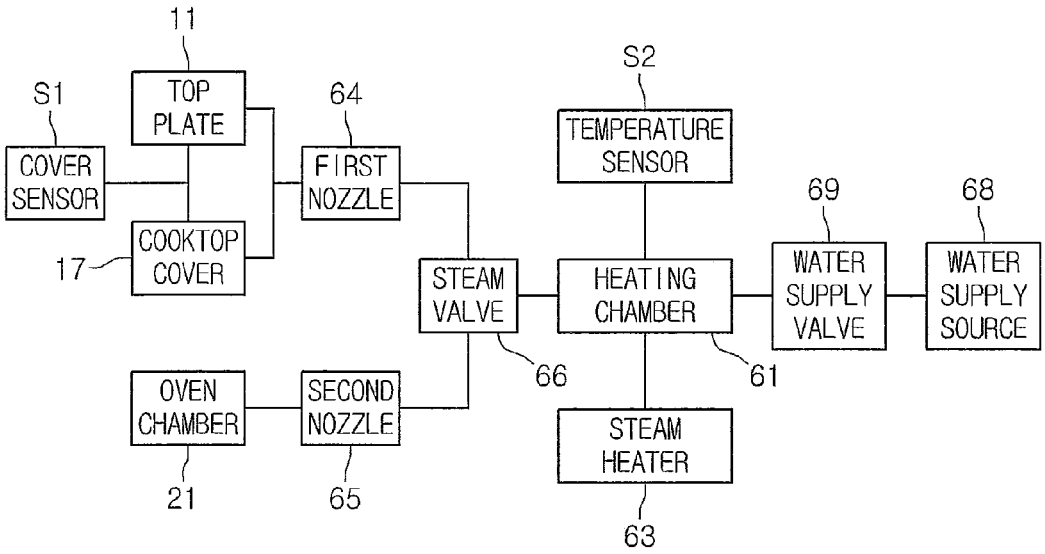
FIG. 4 is a schematic block diagram of a cooking appliance according to a third embodiment.
Figure 5:
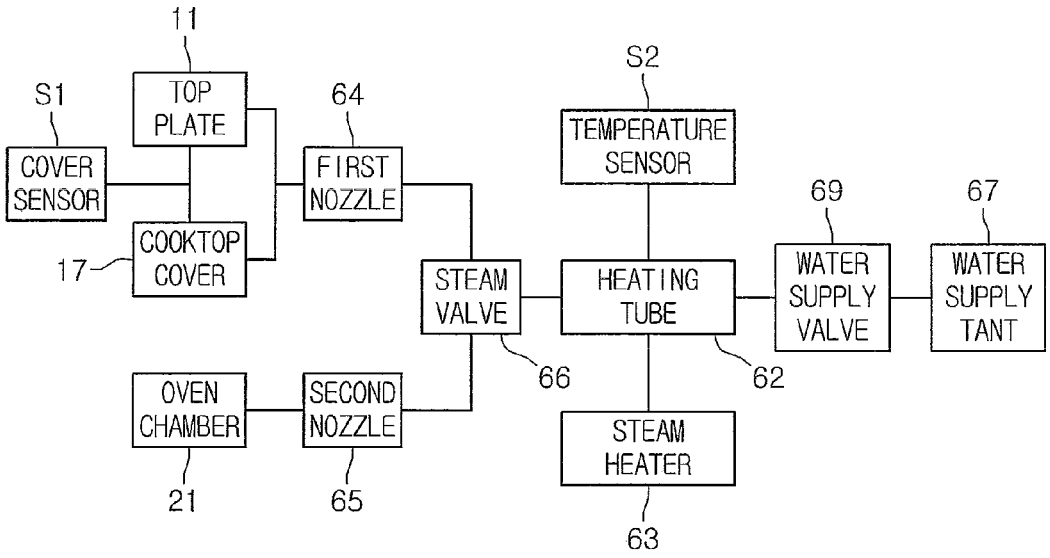
FIG. 5 is a schematic block diagram of a cooking appliance according to a fourth embodiment.

FIG. 4 is a schematic block diagram of a cooking appliance according to a third embodiment. FIG. 5 is a schematic block diagram of a cooking appliance according to a fourth embodiment.

Referring to FIG. 4, in the third embodiment, steam water is directly transferred from an external water supply source 68 to a heating chamber 61. Thus, it is unnecessary to store the steam water in a water supply tank 67 to supply the steam water into the heating chamber 61.

Referring to FIG. 5, in the fourth embodiment, the steam water stored in the water supply tank 67 flows into a heating tube 62. The steam water flowing into the heating tube 62 is heated by a steam heater 63 to generate steam. That is to say, in the current embodiment, the steam water stored in the water supply tank 67 is heated by the steam heater 63 while flowing into the heating tube 62, but is not stored in the water supply tank 75. Thus, it may prevent the heating chamber 61 from being contaminated by the steam water that is not heated by the steam heater 63, but remains in the heating chamber 61.

Since the rest parts of the third and fourth embodiments are equal to those of the first or second embodiment, their detailed descriptions will be omitted.

It should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

In the embodiments, although the first input unit receives the manipulation signal for supplying the steam into the space between the top plate and the cooktop cover and the second input unit receives the manipulation signal for supplying the steam into the oven chamber, the present disclosure is not limited thereto. That is, the present disclosure is not limited to the constitution of the input unit for receiving the manipulation signals for supplying the steam. For example, the first input unit may receive the manipulation signals for supplying the steam into the space between the top plate and the cooktop cover and the inside of the oven chamber.

Also, in the fourth embodiment, the steam water may be directly supplied from an external water supply source.

According to the embodiments, the steam generated in the one steam generation part may be used in a lot of uses.

As described above, in the cooking appliance according to the embodiments, the following effects may be expected.

The steam generated in the one steam generation part may be selectively supplied into the cooktop part and the oven part. Thus, the steam generated in the one steam generation part may be used in a lot of uses.

Also, the foreign material attached to the top surface of the top plate may be cleaned by the steam supplied into the cooktop part. Therefore, the cooktop part may be more easily cleaned.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance comprising:

a cooktop part comprising:

a top plate to which an object is seated;

a plurality of heating sources disposed under the top plate; and a top frame disposed on an edge of the top plate, the top frame being provided with a steam injection hole;

a cooktop cover that covers the top plate and the steam injection hole, a space being defined by the cooktop cover and the top plate;

an oven part disposed under the cooktop part; and a steam generation part to generate steam supplied to the space and into the oven part, wherein the plurality of heating sources and the cooktop cover overlap each other in a vertical direction when the cooktop cover covers the top plate.

2. The cooking appliance according to claim 1, wherein the steam generated by the steam generation part is supplied to at least one of the space and the oven part.

3. The cooking appliance according to claim 1, wherein the steam generation part comprises:

a heating chamber in which steam water is stored;

a steam heater heating the steam water stored in the heating chamber to generate steam; and a steam valve controlled to selectively supply the steam to at least one of the space and the oven part.

4. The cooking appliance according to claim 1, wherein the steam generation part comprises:

a heating tube in which steam water flows;

a steam heater heating the steam water flowing into the heating tube to generate steam; and a steam valve controlled to selectively supply the steam to at least one of the space and the oven part.

5. A cooking appliance comprising:

a cooktop part comprising:

a top plate;

a plurality of heating sources disposed under the top plate; and a cooktop cover to selectively cover an upper surface the top plate, at least one of the plurality of heating sources heating an object seated on the top plate;

an oven part disposed under the cooktop part, the oven part comprising an oven chamber and at least one heating device for heating an object received in the oven chamber; and a steam generation part to generate steam supplied into at least one of a space between the top plate and the cooktop cover and an inside of the oven chamber, wherein the plurality of heating sources and the cooktop cover overlap each other in a vertical direction when the cooktop cover covers the top plate.

6. The cooking appliance according to claim 5, wherein the steam is supplied into the space between the cooktop cover and the top plate only in a state where the cooktop cover covers the top plate.

7. The cooking appliance according to claim 5, further comprising a sensor part detecting whether the top plate is covered by the cooktop cover.

8. The cooking appliance according to claim 5, wherein at least one portion of the cooktop cover is formed of a transparent or semitransparent material.

9. The cooking appliance according to claim 5, wherein the heating source of the cooktop part is operated only when the top plate is opened by the cooktop cover.

10. The cooking appliance according to claim 5, wherein an operation of the heating source of the cooktop part and the supply of the steam into the space between the top plate and the cooktop cover are not performed at the same time.

11. The cooking appliance according to claim 5, wherein the steam generation part comprises:

a heating chamber in which steam water is stored;

a steam heater heating the steam water stored in the heating chamber to generate steam;

a first nozzle to inject the steam into the space between the top plate and the cooktop cover;

a second nozzle to inject the steam into the oven chamber; and a steam valve controlled to selectively supplying the steam into at least one of the first and second nozzles.

12. The cooking appliance according to claim 5, wherein the steam generation part comprises:

a heating tube in which steam water flows;

a steam heater heating the steam water flowing into the heating tube to generate steam;

a first nozzle to inject the steam into the space between the top plate and the cooktop cover;

a second nozzle to inject the steam into the oven chamber; and a steam valve controlled to selectively supplying the steam into at least one of the first and second nozzles.

13. The cooking appliance according to claim 5, further comprising an output unit outputting a signal for informing at least one of completion of the steam supply into the space between the top plate and the cooktop cover and elapse of a preset time after the steam is completely supplied into the space between the top plate and the cooktop cover.

14. The cooking appliance according to claim 5, further comprising an output unit outputting an alarm signal when a manipulation signal for operating the steam generation part is received to generate steam supplied into the space between the top plate and the cooktop cover in a state where the top plate is opened by the cooktop cover.

15. The cooking appliance according to claim 5, wherein the steam generation part is not operated even though a manipulation signal for operating the steam generation part is received to generate steam supplied into the space between the top plate and the cooktop cover in a state where the top plate is opened by the cooktop cover.

16. The cooking appliance according to claim 5, further comprising an output unit outputting an alarm signal when the top plate is opened by the cooktop cover while steam is supplied into the space between the top plate and the cooktop cover.

17. The cooking appliance according to claim 5, wherein the steam is not supplied into the space between the top plate and the cooktop cover when the top plate is opened by the cooktop cover while steam is supplied into the space between the top plate and the cooktop cover.

* * * * *